United States Patent [19]

Green et al.

[11] Patent Number: 4,510,020

[45] Date of Patent: Apr. 9, 1985

[54] LUMEN-LOADED PAPER PULP, ITS PRODUCTION AND USE

[75] Inventors: Harold V. Green, Dollard des Ormeaux; Thomas J. Fox, Kirkland; Anthony M. Scallan, Pointe Claire, all of Canada

[73] Assignee: Pulp and Paper Research Institute of Canada, Pointe Claire, Canada

[21] Appl. No.: 158,753

[22] Filed: Jun. 12, 1980

[51] Int. Cl.[3] ..... D21H 3/40

[52] U.S. Cl. ..... 162/169; 162/181.1; 162/181.2; 162/181.5; 162/181.8; 162/182; 162/183

[58] Field of Search ..... 162/181 R, 182, 183, 162/162, 181.1, 181.2, 181.5, 181.8

[56] References Cited

PUBLICATIONS

Haslam, J. H. et al., "The Retention of Pigments in Paper," *Paper Trade Journal* (Tappi Sec., pp. 22–25), pp. 36–39, Jan. 9, 1936.

Casey, *Pulp and Paper*, vol. II (1960), pp. 986–989, 996–999, 1001, 1002, 1005–1015.

*Primary Examiner*—Peter Chin

*Attorney, Agent, or Firm*—Millen & White

[57] ABSTRACT

Paper of improved properties is produced from pulp in which filler is selectively loaded within the fiber lumens by agitating a suspension of pulp and filler until the fiber lumens become loaded with filler, separating the residual suspended filler from the loaded fibers and vigorously washing the pulp until substantially all of the filler on the external surfaces of the fibers is removed.

20 Claims, No Drawings

LUMEN-LOADED PAPER PULP, ITS PRODUCTION AND USE

FIELD OF INVENTION

This invention relates to an improved process for the production of filler-containing paper pulp in which the filler is substantially all in the lumens of the cellulose fibers and to novel papers produced from such fibers.

DESCRIPTION OF THE PRIOR ART

An essential property of paper for many end uses is its opacity. It is particularly important in papers for printing, where it is desirable that as little as possible of the print on the reverse side of a printed sheet or on a sheet below it be visible through the paper. For printing and other applications, paper must also have a certain degree of whiteness (or brightness as it is known in the paper industry). For many paper products, acceptable levels of these optical properties can be achieved from the pulp fibers alone. However, in other products, the inherent light-reflective powers of the fibers are insufficient to meet consumer demands. In such cases, the papermaker adds a filler to the papermaking furnish. A filler consists of fine particles of an insoluble solid, usually of a mineral origin. By virtue of the high ratio of surface area to weight (and sometimes high refractive index), the particles confer high light-reflectance to the sheet and thereby increase both opacity and brightness. Enhancement of the optical properties of the paper produced therefrom is the principal object in adding fillers to the furnish although other advantages, such as improved smoothness and improved printability, can be imparted to the paper. Furthermore, replacing fiber with an inexpensive filler can reduce the cost of the paper. However, filler addition does pose some problems.

One problem associated with filler addition is that the mechanical strength of the sheet is less than could be expected from the ratio of load-bearing fiber to non-load-bearing filler. The usual explanation for this is that some of the filler particles become trapped between fibers, thereby reducing the strength of the fiber-to-fiber bonds which are the primary source of paper strength.

A second problem associated with the addition of fillers is that a significant fraction of the small particles drain out with the water during sheet formation on the paper machine. The recovery and recycling of the particles from the drainage water, commonly known as the white water, poses a difficult problem for the papermaker. In seeking to reduce this problem, many researchers have examined the manner in which filler is retained by a sheet. It has become accepted that the main mechanism is co-flocculation, i.e., the adhesion of pigment particles to the fibers. As a result of this finding, major effort in filler technology has gone into increasing the adhesive forces. This work has lead to the development and use of a wide variety of soluble chemical additives known as retention aids. The oldest and the most widely-used of these is aluminum sulfate (Papermakers' alum) but in recent years a variety of proprietary polymers have been introduced. With all of these retention aids, however, retention is still far from complete. A further mechanism of retention is filtration of pigment particles by the paper web. This is relatively important with coarse fillers but its effect is negligible with fine fillers.

Haslam and Steele (Paper Trade J. 102 (2) 36 (1936)) conducted an early study of the mechanism of retention of filler after the filler and pulp had been mixed by a conventional treatment in a beater. One test given the mixture was repeated washing of the pulp in order to remove filler retained by the mechanisms of co-flocculation and filtration. A small residual filler content remained and they considered this filler to be retained by a third mechanism which they termed "mechanical attachment". Microscopy revealed that most of the filler was present in the fiber lumens. The authors give no indication that a paper produced from these fibers would have any properties which would differ significantly from a conventionally-filled sheet. This finding has not been developed in any way since 1936. Subsequent workers apparently have regarded the lumen-held filler to be a negligible and unimportant fraction of the total filler retained in conventionally-filled pulp. We have found, surprisingly, that such fibers produce papers of an enhanced combination of strength and optical properties.

Craig (U.S. Pat. No. 2,583,548) described how a pigmented cellulosic pulp could be produced by precipitating pigment "in and around" the fibers. According to his invention, dry cellulosic fibers are added to a solution of one reactant, for example calcuium chloride, and the suspension is mechanically worked so as to effect a gelatinizing of the fibers. A second reactant, for example sodium carbonate, in then added so as to effect the pecipitation of fine solid particles of, for example, calcium carbonate, "in and on and around" the fibers. The fibers are then washed to remove the soluble by-product, for example sodium chloride. Craig visualized such pigmented fibers as containing more pigment than cellulose and being used as a paper additive with superior retention to that of pure filler. While there is no doubt that the fibrous form of the additive would give it good retention, the process does have considerable limitations. The presence of filler on fiber surfaces and the gelatinizing effect on the fibers are detrimental to paper strength. Furthermore the technique is limited to introducing fillers into paper which can readily be produced by precipitation in situ, which precludes the use of such important filler materials like titanium dioxide and clay. In any event, it is doubtful whether the particle size could be controlled so as to be neither too small nor too large for optimal light-reflective properties.

Thomsen (U.S. Pat. No. 3,029,181) also discloses an invention involving the precipitation of pigment in the presence of fibers. Although the process is alleged to have advantages over that of Craig, the product still suffers from many of the limitations of the earlier one.

SUMMARY OF THE INVENTION

In a product aspect, this invention relates to novel filler-containing papers in which substantially all of the filler is within the fiber lumens.

In process aspects, this invention relates to a process for the production of filler-containing paper pulp suitable for the production of the novel papers of this invention and to a process for the production of the novel papers employing the thus-produced paper pulp.

According to a process aspect of this invention, filler-containing paper pulp in which substantially all of the filler is positioned within the fiber lumens, is produced by the steps of (a) agitating a suspension of the paper pulp and an excess of insoluble filler having an average particle size smaller than the average pore size of the lumen entrances of the pulp fibers until the fiber lumens become loaded with filler to at least 0.5% of the dry weight of the pulp;

(b) separating the filler-containing pulp from the suspension of residual filler; and (c) vigorously washing the filled pulp until substantially all of the filler on the external surfaces of the fibers is removed. The process is enhanced by conducting at least the washing step with a stream of water containing a retention aid.

According to another process aspect of this invention, papers of an improved combination of strength and opacity are produced by employing filler containing pulp in which substantially all of the filler is within the fiber lumens.

In another process aspect of this invention, the usual loss of pigment into the white water of a paper machine is reduced by using filler-containing paper pulp according to the process of this invention.

In yet another process aspect of this invention, the filler particles in the liquor issuing from the washing step are concentrated and recycled to step (a) and the cleared liquor is reused for washing (step c).

DETAILED DESCRIPTION OF THE INVENTION

The structure of papermaking fibers is an integral aspect of this invention. The most widely-used fibers are those derived from wood and, as liberated by pulping, the majority appear under the microscope as long hollow tubes, uniform in size for most of the length but tapered at each end. Along the length of the fiber, the fiber wall is perforated by small apertures (pits) which connect the central cavity (lumen) to the fiber exterior. In wood, the pits are spanned by a structure causing them to act like valves to the passage of water and, even when open, to act like a sieve to the passage of small particles (e.g., micro-organisms). This structure is usually removed during pulping, leaving the pit as a simple hole. However, on occasion, it remains almost intact and functional.

The strength of paper is highly dependent upon the fibers of the pulp, used to make the paper, becoming bonded extensively to one another during papermaking. It is therefore a common practice to "beat" fibers, beating being a special kind of mechanical treatment in water. This plasticizes the fibers, rendering them capable of collapse from a tube-like to a ribbon-like shape which permits extensive bonding of the fibers during the papermaking operation. Prolonged beating has other effects. One is the production of what is visible under the optical microscope as a fine fuzz on the outer surface of the fiber. This is the partial dislodgement of the fine filaments (fibrils) of cellulose which make up the structure of the cell wall. The phenomenon is known as fibrillation. A further effect is fiber cutting, which is important to this invention because it renders the lumen directly accessible via the cut ends.

The process of this invention for putting small particles within the lumens is applicable to a wide range of papermaking fibers. The process can be carried out on pulps dervied from many species of wood by any of the common pulping and bleaching procedures. The pulp can enter the process in a "never-dried" form or it may be reslurried from a dried state. However, because of variations in fiber structure with fiber origin, the degree of lumen-loading obtained with a given set of conditions does vary from one type of pulp to another. The fibers may also have received some mechanical treatment, such as refining or beating prior to lumen-loading. Although in some cases, rather than entering the lumen, the filler particles tend to become filtered out on the intact pit structure, this effect may be largely overcome by increasing the intensity of the mechanical aspects of the impregnation step in the process. Hollow filament rayon can be "lumen-loaded" by this technique, and other synthetic fibers bearing accessible internal cavities may similarly be treated. Similarly, fibers having lumen-like interior cavities which ar derived from plants other than trees may be lumen-loaded with filler according to this invention.

Although located within the lumens, the filler nevertheless interacts with light and therefore improves the opacity and/or brightness of paper produced from the fibers. Because the filler is within the lumens, it does not interfere with fiber-to-fiber bonding. Thus, the strength of the sheet is higher than a sheet filled conventionally to the same level. Furthermore, because the filler is located within the lumens of the fibers, it is protected by the cell walls from the drainage forces which normally cause filler dislodgement during papermaking. Thus, the problem of filler retention is much reduced.

There are some pretreatments of fibers which render them less susceptible to the full benefits of the novel process. For example, extensive pulping and/or beating followed by severe drying and/or pressing can irreversibly collapse a large portion of the lumens and thus render them inaccessible to the filler particles. In addition, fibrillated pulps, such as highly-beaten chemical pulps and most mechanical pulps, also pose a problem. With these pulps satisfactory levels of lumen-loading can be achieved but the fibrillated external surfaces tenaciously hold pigment throughout the washing treatment. Nevertheless, such pulps can benefit from the process of this invention as a result of the improvement in subsequent retention on the paper machine.

The main criterion of the filler particles which are employed in the novel process, is that the material be of such a particle size that it can enter the lumen via the accessible openings, i.e., pits or cut fiber ends. Pit openings vary in diameter with fiber species. However, the pits of most species are sufficiently large to admit many of the filler materials commonly employed in papermaking. Particularly satisfactory are those materials which have a diameter range of 0.2 to 0.5 micrometers for optimal light-scattering power, e.g., titanium dioxide and polystyrene pigments. However, in some cases, the particle diameter can be as high as 4.0 micrometers. Other fillers, in the form that they are usually employed in the paper industry, are not immediately suitable because of their excessively large particle size. Regular clay is such an example. However, there are fine grades of this material which can be loaded into the lumens. Examples of other filler particles which can be employed are fine pigment grades of calcium carbonate, alumina, silica and zinc sulfide.

Having described the prerequisites of the fibers and the filler particles, the following is a description of the three steps of the lumen-loading process, viz., (i) impregnation, (ii) washing, and optionally, (iii) recovery and recycling.

(i) Impregnation: In this step a suspension of fiber and filler particles in water is vigorously agitated. The conditions for impregnation can vary widely. Firstly they depend upon the desired level of filler particle loading, which, in turn, depending upon the product being made, might be from 1% to over 40% of the dry weight of the fibers. Secondly, the conditions for a given degree of loading are a function of the filler, the pulp and the apparatus used for impregnation. Thus it has been found that the dry weight ratio of filler to fibre can be from 0.01:1 to 10.0:1 and the pulp concentration 1 to 50 g/liter.

The agitation time required to achieve maximum or optimum lumen loading is dependent primarily upon the degree of agitation. With relatively gentle agitation, impregnation times of up to 2 hrs. may be required and with turbulent agitation, as little as 5 min. may suffice. The rate of lumen filling can be determined by measuring the filler content of the fibres in aliquots taken from the impregnation vessel at periodic intervals during the impregnation step, after washing the fibers as described hereinbelow. For many mineral fillers, the filler content can be determined by measuring the ash content.

There are many methods of achieving adequate agitation. The simplest is to rapidly stir the suspension. The degree of lumen-loading increases with the time and speed of agitation and the concentration of particles in suspension. In order to explain the dependence of the impregnation step upon these variables, it is postulated that the external suspension is drawn in the lumens by their alternate collapsing and reopening as induced by the agitation. Once inside the fibers, the pigment is attracted to and held to the surfaces of the lumens by colloidal forces and therefore is not forced out during the next collapse.

Following completion of impregnation, it is convenient to remove the fibers from the residual filler particle suspension by filtration. The particle suspension is then saved for the treatment of a second batch of fibers.

(ii) Washing: In this stage, lumen-filled fibers are separated from the residual filler particle suspension and from substantially all of the filler particles externally adhering to the fibers, without unduly disturbing the lumen contents. These objectives can be accomplished, for example, by turbulently washing the pulp with wash water while containing it above a screen of such a mesh size as to permit the passage of the filler particles therethrough but not the fibers. Sufficient shear can be induced by this washing action to overcome the colloidal forces holding the filler particles to the exeranal surfaces. As a consequence, the particles are dislodged and carried away. On the other hand, the particles within the lumen remain protected from the shear forces by the fiber wall. Washing is continued until microscopy reveals that substantially all the residual filler is within the fiber lumens. The percentage of the total filler within the lumens is at least 90% with well-washed fibers.

After washing, an aqueous suspension of externally-clean, lumen-loaded fibers ready for papermaking is obtained.

(iii) Filler recovery and recycling: In carrying out the lumen-loading process on an industrial level, it is desirable to clarify the wash water from step (ii) in order to reuse both the residual filler particles and the water. Methods of accomplishing clarifications are well known to the paper industry. Most common are those based upon flotation, sedimentation, centrifugation or filtration. Any of these existing systems may be used. Alternatively, a method especially suitable for use with the lumen-loading process is to use a second batch of fresh pulp to form a filter bed upon a screen. The wash water can be clarified by repeated circulation through such a bed. Following completion of the washing of one batch of pulp, the pad of pulp used as a filter may then, with its adhering load of filler particles, by recycled to the impregnation stage, preferably along with fresh filler as required to return its concentration to the starting level employed with the first batch of pulp.

Papermakers' alum may be present with advantage in the process water. Alum increases the colloidal forces which attract particles to one another and thus causes them to form flocs. Such flocs are more easily removed than single particles during the washing step. Such flocs are also more easily separated from the wash water during the recovery step. If however the concentration of alum is too high, it will create flocs of such a size and resistance to shear that they will not break up to yield small particles capable of entering the lumens during impregnation. Alum may be substituted in the process by other retention aids and occasionally with some advantage. The use of salts of divalent metals, e.g., caclium, or cationic polymers, e.g., polyethyleneimine, yields paper of even superior strength at any given degree of lumen-loading. These materials may also be used in conjunction with calcium carbonate as a filler, where alum is not as suitable because of its acidic nature.

The use of dispersants in the novel process appears undesirable as they tend to keep the filler particles as individuals rather than flocculating them. Thus, dispersants act in an opposite manner to retention aids.

In the process of this invention, after washing, the lumen-loaded fibers may be subjected to mild agitation, e.g., 100 min. in a British Disintegrator. They should not, however, be subjected to excessive agitation, such as prolonged beating, as some of the filler in the lumen may be dislodged. Therefore, any extensive agitation should occur prior to lumen-loading or during the impregnation stage.

Paper fibers lumen-loaded with filler can be used in a wide variety of applications. The following are some of the widest categories, bearing in mind there are also many speciality products which are produced in smaller quantities.

(1) Fine papers: A broad class of papers used for printing and writing. Generally, the papers contain fillers. One advantage of feeding the lumen-loaded fibers to a paper machine used in making fine paper, rather than the usual mixture of fiber and filler, is greater retention of the filler. This leads to better control of properties and cleaner machine operation. In addition to the paper being stronger than a corresponding paper conventionally-filled to the same level, the paper made from lumen-loaded fibers exhibits less "two-sidedness" and a lesser tendency for the filler to "dust-off".

(2) Unbleached kraft pulp: Unbleached kraft pulp is used in products such as bags and wrapping papers because of its high strength. However, it has very low brightness, thus making it both unattractive and a poor substrate for print. Lumen-loading, unbleached kraft pulp considerably improves the brightness of the paper produced therefrom with less strength loss than conventional loading.

By lumne-loading unbleached kraft pulp, the brightness of semi-bleached kraft pulp can be approached or matched. Consequently, semi-bleached kraft pulp can be replaced in many products by the lumen-filled unbleached kraft pulp of this invention. In this application, the lumen-loading process would replace the bleaching treatment and yield a pulp which is of comparable brightness but is more opaque than the corresponding semi-bleached kraft pulp.

(3) Light-weight newsprint: Most newsprint is currently made from a mixture of mechanical and chemical pulp without filler. There is a demand for such products of lower basis weight (pulp weight per unit area). One of the most critical barriers to achieving substantial decreases in basis weight is that the opacity of the sheet is excessively reduced. Filler is not currently added to offset this loss in opacity for various reasons, including the strength loss it causes in the sheet and the "messiness" it imparts to the papermaking operation. By lumen-loading the chemical pulp fraction of by using only lumen-loaded chemical pulp, these problems are reduced and acceptable levels of opacity can be achieved at lower basis weights.

In a preferred aspect, the newsprint has a basis weight of less than 32 lb/ream and the lumen-held filler constitutes at least 1% of the dry weight of the said newsprint.

Although this invention relates to lumen-loading cellulose fibers with filler particles, it will be apparent to those skilled in the art that the lumen-loading principle can be used with other types of insoluble particles to confer unique properties on the fibers in preceding or subsequent treatments.

Compared to otherwise identical paper produced with the same pulp filled in a conventional manner with the same amount of the same filler, the novel papers of this invention exhibit one or more of improved tensile strength, stretch, toughness, burst index, tear index and MIT Double Fold values.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

EXAMPLE 1

A pulp was prepared by cooking back sprucewood to a yield of 47% by the kraft process. Following washing at a low consistency, the pulp was concentrated to a solids content of 32%.

An amount of this moist pulp corresponding to 1 g dry weight of fiber was added to 10 g of a commercial titanium dioxide pigment and the mixture diluted to 400 ml with water containing alum (0.1 g/liter). The suspension was then stirred with a motor-driven laboratory stirrer. Stirring was conducted at 350 rpm for 20 minutes. At the end of this time, the pulp was filtered from the bulk of the pigment suspension and rediluted to 400 ml with additional alum solution. The pulp was then freed of externally deposited titanium dioxide by turbulent washing with additional alum solution. This was accomplished by containing the pulp suspension above a screen (or a mesh size permitting passage therethrough of pigment but not fiber). A constant head of liquid was maintained above the screen and the liquid was stirred sufficiently rapidly to hold the pulp in suspension. Alum solution was passed through the suspension until the effluent was clear.

Examination of the fibers under the optical microscope showed that most of the fibers contained considerable pigment within the lumens and their exterior surfaces were free of pigment. An examination of the same fibers under the scanning electron microscope confirmed the substantial absence of pigment particles on the external surfaces of the fibers. An ash determination revealed that the fibers contained 8% by weight of titanium dioxide, based on the dry weight of the fibers.

EXAMPLE 2

By repeating the procedure of Example 1 but using different pulps, the lumens of the plups listed in Table 1 were similarly loaded selectively with titanium dioxide. As shown in Table 1, the level of loading does however vary with wood species, pulping and bleaching history and whether or not the pulp is neverdried or in dry lap form. In most cases, the procedure yields fibers which are not only lumen-loaded but have external surfaces free of particles. However, in the case of highly fibrillated pulps (extensively beaten chemical pulps and most mechanical pulps) the external surfaces are not free of pigment.

TABLE 1

Pulps lumen-loaded with titanium dioxide and washed by the procedure of Example 1

| Pulp Type | | Wood Species | Drying History | Ash % |
|---|---|---|---|---|
| Unbleached kraft | (unbeaten) | Black spruce | never-dried | 8.3 |
| | | Douglas fir | never-dried | 4.8 |
| | | White pine | never-dried | 14.5 |
| | | Loblolly pine | never-dried | 10.8 |
| Bleached kraft | (unbeaten) | Douglas fir | never-dried | 3.1 |
| | | White pine | never-dried | 14.4 |
| | | Loblolly pine | never-dried | 7.4 |
| | | Mixed hardwoods | never-dried | 3.9 |
| | | Fir/larch | dry lap pulp | 4.2 |
| | | Spruce/balsam | dry lap pulp | 6.3 |
| | | Cedar | dry lap pulp | 7.7 |
| Unbleached sulfite | (unbeaten) | Black spruce | never-dried | 7.4 |
| | (beaten) | Black spruce | never-dried | 10.0* |
| Thermo-mechanical | | Softwoods | never-dried | 5.4 |
| Refiner | | Softwoods | never-dried | 9.7* |

*External surfaces of fibers were pigmented

EXAMPLE 3

Procedures similar to Example 1 were carried out using particles of precipitated calcium carbonate, levigated alumina, ultra-fine clay, coloured pigments, silica, zinc sulfide, colloidal carbon, polystyrene pigments and polyvinyl and polyacrylic latexes, of a particle size small enough to penetrate the fiber lumens. Examination of the fibers by optical microscopy revealed that as long as the particle size was sufficiently small to permit their entry into the lumens, all substances examined could be loaded into the lumen and the exterior surfaces of the fibers could be washed clean.

EXAMPLE 4

The procedure of Example 1 was repeated except the concentration of alum solution used throughout was varied at various levels in the range of 0 to 3.0 g/liter. As Table 2 shows, an alum concentration in the range of 0.01 to 0.3 g/liter is optimum for obtaining well-loaded and externally-clean fibers. Below this range the fiber exteriors are still coated with $TiO_2$ particles and above this range, the efficiency of the loading is lowered. The optimum alum concentration is also affected by other variations of the conditions of Example 1 and on other fiber/filler combinations.

TABLE 2

| The Effect on varying the concentration of alum | |
|---|---|
| Alum concentration, g/L | Ash, % |
| 0 | 15.4* |
| 0.01 | 9.1 |
| 0.03 | 8.6 |
| 0.1 | 8.3 |
| 0.3 | 8.7 |
| 1.0 | 5.0 |
| 3.0 | 5.1 |

*External surfaces of fibers were pigmented.

EXAMPLE 5

The procedure of Example 1 was repeated except for the following variations in conditions: the initial solids content of the pulp, 0.25% to 90%; pulp charge, 0.25 to 8.0 g (dry weight); temperature, 20° to 100° C.; and pH, 4 to 10. Some slight variations in the degree of loading occurred within these ranges. However, to a good approximation, the process functioned equally well under all conditions.

EXAMPLE 6

The procedure of Example 1 was repeated except the concentration of titanium dioxide in the impregnation liquor and the time and speed of stirring during impregnation were varied over a range of values. As shown in Table 3, the level of lumen loading increased with the concentration of titanium dioxide and with both the time and speed of stirring. It is apparent from the results of these experiments that the concentration of particles and the amount of agitation are the important process variables of the impregnation step.

TABLE 3

| The effect of varying certain impregnation conditions | | | |
|---|---|---|---|
| Stirring Speed r.p.m. | Stirring Time mins. | Concn. $TiO_2$ g/L | Ash % |
| 350 | 20 | 25 | 8.9 |
| 350 | 40 | 25 | 11.5 |
| 350 | 20 | 50 | 11.3 |
| 350 | 40 | 50 | 12.4 |
| 1000 | 20 | 25 | 12.6 |
| 1000 | 40 | 25 | 14.1 |
| 1000 | 20 | 50 | 14.5 |
| 1000 | 40 | 50 | 15.0 |

EXAMPLE 7

The impregnation stage of the lumen-loading process was carried out on a larger scale using a pulper of 24 inch diameter fitted with a variable speed motor. Five hundred grams of titanium dioxide pigment and the moist equivalent of 500 g of unbleached kraft pulp were confined above the bed plate along with 50 liters of alum solution of a concentration of 1 g/liter. The rotor was then driven at its lowest speed (630 r.p.m.) and small samples of the suspension were withdrawn at various times. The samples were washed by the procedure of Example 1. Examination of the washed fibers by optical microscopy showed the fibers to be lumen-loaded and externally clean. Ash determinations on the washed fibers were carried out to determine the levels of loading achieved. The ash contents of the washed pulps after various times of treatment in the pulper were: 1 min, 3.4%, 2 min, 4.5%; 4 min, 5.6%; 8 min, 7.1%; and 16 min, 9.4%.

The impregnation step was also successfully carried out using a laboratory beater, a British Disintegrator and by single and multiple passages of a suspension of filler and fiber through a centrifugal pump.

EXAMPLE 8

10 g amounts of the unbleached kraft pulp described in Example 1 were impregnated by stirring at 1100 rpm for 20 minutes in 3600 ml of 0.125 g/liter alum solution containing amounts of titanium dioxide pigment of up to 200 g/liter. The pulps were drained free of supernatant liquor and then washed with additional alum solution. Quantities of pulp which were lumen-loaded to varying degrees were thus obtained. Sets of handsheets were prepared therefrom and tested according to the standards of the Technical Section of the Canadian Pulp and Paper Association.

10 g amounts of the same pulp were similarly stirred at 1100 rpm for 20 minutes in 3600 ml of the alum solution. Standard handsheets were made from batches of pulp with titanium dioxide suspension being added in the sheet machine. By varying the ratio of pigment to pulp, sets of sheets were prepared at the standard basis weight of 60 g/m$^2$. These sheets were thus "conventionally-loaded" to different levels. All sheets were then tested.

Plots were made of the various sheet properties as a function of pigment content (ash content) for the two types of sheet. Interpolation of this data permits a comparison of the two methods of filler addition at any level of pigment uptake. Table 4 contains the data at 10% pigment content and shows that equal improvements in brightness and opacity resulted from filler addition, irrespective of the manner of addition. However, the strength properties of the lumen-loaded sheets were considerably greater.

TABLE 4

| Physical Properties of Handsheets | | |
|---|---|---|
| | Conventionally loaded sheet | Lumen-loaded sheet |
| Ash content, % | 10.0 | 10.0 |
| Basis weight, g/m$^2$ | 60. | 60. |
| ISO Brightness, % | 52.0 | 52.0 |
| Printing Opacity, % | 99.4 | 99.4 |
| Breaking Length, km | 2.3 | 4.3 |
| Stretch, % | 0.8 | 1.6 |
| Toughness, mJ | 12. | 42. |
| Burst Index, kPa · m$^2$/g | 0.8 | 2.0 |
| Tear Index, mN · m$^2$/g | 11. | 21. |
| MIT Double Folds | 2. | 30. |

EXAMPLE 9

It requires 1.20 g of papermaking furnish retained on the wire mesh of a handsheet machine in order to achieve a standard basis weight of 60 g/m$^2$ in the finished handsheet. In the preparation of sheets of lumen-loaded fibers, 1.20 g of the fibers were charged to the handsheet machine and the resultant sheets invariably were 60 g/m$^2$, within experimental error. Retention of both fiber and filler during sheet preparation was thus effectively 100%.

EXAMPLE 10

A closed-loop washing device was constructed from a vertical cylindrical vessel subdivided into three compartments by two horizontal screens. The screens were of a mesh size which permitted passage therethrough of filler but not fiber. The upper compartment contained a stirrer paddle; the middle compartment contained a pad of pulp; and the lower compartment was connected to a centrifugal pump connected in turn by tubing to the top compartment. The device was filled with alum solution.

Unwashed lumen-loaded pulp was added to the upper compartment and kept in suspension by stirring. The pump was then started, thus circulating liquid from the top compartment through the pulp pad and back to the top compartment via the external tubing. In this manner, the lumen-loaded fibers confined to the top compartment could be washed free of external pigment and all the liberated pigment collected on the pulp pad in the central compartment.

Following this procedure, continuous wash water clarification and the recovery of most if not all of the unused pigment particles on a pad of pulp can be achieved.

EXAMPLE 11

A 2 g sample of unbleached kraft pulp at 40% consistency was placed in a suspension of 5 g of titanium dioxide in 800 ml of 1.25 g/liter alum. The pulp was then impregnated by circulation through a small centrifugal pump for 20 min.

The whole suspension was then transferred to the upper compartment of the device described in Example 10, which contained a further 2 g sample of pulp as a filter and the balance of the alum solution required to fill the device (total capacity 2000 ml). The pulp was washed as described above. Upon completion of washing, the suspension of washed pulp was syphoned from the upper chamber and filtered from the alum solution. The pulp filter was removed and all alum solution was reserved.

The pulp used as a filter, along with its adhering load of pigment, was then transferred to the impregnation vessel to which was added 0.2 g of titanium dioxide and sufficient amounts of the used alum solution to bring the mixture up to the strength of the original impregnation liquor. The pulp was then impregnated as before and washed in the device containing a third 2 g sample of the pulp as a filter and the residual alum solution.

By these procedures, ten successive samples of pulp were used as a filter, impregnated and then washed, using as much as possible the same recycled titanium dioxide and alum solution. Microscopic examination showed that the external surfaces of the fibers of all samples were clear of pigment and the ash contents of the samples all were within the range of 6 to 8%.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

We claim:

1. Unbleached kraft paper in which substantially all of the filler is within the lumens of the cellulose fibers, said paper having improved strength properties compared to a corresponding conventionally-filled paper containing the same amount of the same filler.

2. A bleached kraft paper in which substantially all of the filler is within the lumens of the cellulose fibers, said paper having improved strength properties compared to a corresponding conventionally-filled paper containing the same amount of the same filler.

3. A fine printing or writing paper in which substantially all of the filler is within the lumens of the cellulose fibers, said paper having improved strength properties compared to a corresponding conventionally-filler paper containing the same amount of the same filler.

4. A lightweight newsprint paper in which substantially all of the filler is within the lumens of the cellulose fibers, said paper having improved strength properties compared to a corresponding conventionally-filled paper containing the same amount of the same filler.

5. A filled paper in which substantially all of the filler is within the lumens of the cellulose fibers, said paper having improved strength properties compared to a corresponding conventionally-filled paper containing the same amount of the same filler, wherein the paper is filled to an ash content of at least 6% and the filler is selected from one or more of the group consisting of titanium dioxide, clay, calcium carbonate, alumina, silica and polystyrene pigments.

6. A paper according to claim 5 wherein the filler is titanium dioxide.

7. In a process for the production of filled paper wherein the starting pulp is mixed with an amount of filler in excess of that desired in the paper and the excess filler not retained by the pulp is recycled, the improvement which comprises producing paper having higher strength than corresponding paper conventionally filled to the same filler content by filling the pulp by the steps of (a) agitating a suspension of the paper pulp and an excess of insoluble filler having an average particle size smaller than the average pore size of the lumen entrances of the pulp fibers, until the pulp is loaded with filler higher than the level desired in the paper and the fiber lumens become loaded with filler to the level desired in the paper;

(b) separating the filler-containing pulp from the suspension of residual filler;

(c) vigorously washing the filler pulp until substantially all of the filler on the external surfaces of the fibers is removed, thereby reducing the loss in strength values in the paper normally associated with filling paper; and (d) recovering on fresh pulp residual filler separated in Step (b) from the filler-containing pulp.

8. A process according to claim 7 wherein the filler is selected from one or more of the group consisting of titanium dioxide, clay, calcium carbonate, alumina, silica and polystyrene pigments.

9. A process according to claim 7 wherein the filler is titanium dioxide.

10. A process according to claim 7 wherein at least the washing step is conducted in the presence of a retention aid.

11. A process according to claim 11 wherein the retention aid is alum.

12. A process according to claim 7 wherein the separated suspension of residual suspended filler obtained in Step (b) is passed through a filter bed of unfilled starting pulp, until substantially all of the filler is retained thereon, and the mixture of the retained filler and the retaining pulp is recycled as starting pulp and filler for Step (a).

13. A process for the production of paper of improved brightness and/or opacity wherein the fibers are unbleached kraft and which comprises of filling the lumens of the fibers with filler according to the process of claim 6.

14. A process for the production of paper of improved brightness and/or opacity wherein the fibers are bleached kraft and which comprises of filling the lumens of the fibers with filler according to the process of claim 6.

15. A process for the production of fine printing or writing paper of improved strength compared to the corresponding paper conventionally-filled with the same amount of the same filler, which comprises filling the fiber lumens with filler according to the process of claim 7.

16. A process for the production of lightweight newsprint of acceptable opacity and strength which comprises of loading all or part of the newsprint pulp will filler according to the process of Claim 7 and forming the newsprint at a pulp basis weight of less than 32 lb/ream.

17. A process according to claim 7 wherein in Step (a) the lumens are loaded to an ash content of above 6% of the dry weight of the pulp.

18. A process according to claim 7 wherein in Step (a) the lumens are loaded to an ash content of at least 8% of the dry weight of the pulp.

19. A process according to claim 10 wherein the waste wash water is recycled to Step (c) after removal of the filler therein.

20. A process according to claim 19 wherein the filler is removed by filtration of the waste wash water through unfilled pulp.

* * * * *